United States Patent [19]

Brossia

[11] 4,042,127

[45] Aug. 16, 1977

[54] SLIP PALLET AND DIVIDER SHEET

[75] Inventor: Charles Edward Brossia, Lakewood, Colo.

[73] Assignee: Adolph Coors Company, Golden, Colo.

[21] Appl. No.: 627,101

[22] Filed: Oct. 30, 1975

[51] Int. Cl.[2] ..... B65D 19/00

[52] U.S. Cl. ..... 214/10.5 R; 108/51.3; 206/386

[58] Field of Search ..... 214/10.5 R, 10.5 S; 108/51.1, 51.3, 53.1; 206/322, 386

[56] References Cited

U.S. PATENT DOCUMENTS

| | | | |
|---|---|---|---|
| 2,328,397 | 8/1943 | Neuman | 214/10.5 R |
| 3,776,145 | 12/1973 | Anderson | 108/51 R |
| 3,850,116 | 11/1974 | Mackes | 214/10.5 R X |

*Primary Examiner*—Robert J. Spar
*Assistant Examiner*—George F. Abraham
*Attorney, Agent, or Firm*—Bruce G. Klaas

[57] ABSTRACT

An apparatus for transporting and stacking, by use of a support device of a lift truck, an array of containers in a predetermined stacked configuration, comprising a pallet member made of one piece of relatively thin plastic sheet material having flap portions permanently formed in an upwardly outwardly extending position, and a divider member made of one piece of relatively thin plastic sheet material having flap portions in a downwardly extending position, the flap portions of the pallet member and of the divider member providing protection for the containers and defining an outwardly diverging slot providing access for insertion of the support device of the lift truck.

17 Claims, 10 Drawing Figures

SLIP PALLET AND DIVIDER SHEET

BACKGROUND OF THE INVENTION

1. Field of the Invention

This invention relates to pallets, and more particularly to improvement in slip pallets and slip pallet divider sheets.

2. Prior Art

Material handling apparatus for both consumer and industrial use is commonly designed for ease of storage and handling in a warehouse. Various kinds of containers for various kinds of goods are commonly arranged in a generally cubical array and are supported on a pallet. The array and pallet may then be lifted by a lift truck and stacked upon another array of containers for conservation of storage space.

Commonly used pallets are constructed from wood with two planar support surfaces separated by spaced rails. The support surfaces have the general size and shape of the array to be supported, and the pallet is about four inches thick. The pallet and array of containers are lifted and moved by inserting the forks of a forklift between the vertically separated support surfaces and the horizontally spaced spacer rails. Wood pallets are relatively expensive and have an undeterminable useful life. Furthermore, the thickness of these pallets takes up useful storage space and their weight adds to transportation expense.

These problems have been somewhat overcome by the development of slip pallets. A slip pallet is a relatively thin sheet of a material, such as chipboard, for supporting the array of containers. The array and slip pallet are lifted by gripping the edge of the pallet and holding it under tension while slipping a platen, or spatula-like member, of the lift truck under the pallet. The platen then lifts the array and pallet and transports them to a desired location where the slip pallet and the array are pushed off of the platen. Although slip pallets offer various advantages over common wooden pallets, some problems have been found in their use. For example, the edge of the slip pallet must be strong enough to be gripped by a gripping mechanism on the lift truck and held under tension while the platen of the lift truck is inserted underneath the pallet. If the pallet material is not sufficiently strong to support this tension, the gripped edge will tear away from the body of the pallet. This problem is particularly pronounced in the use of chipboard or cardboard slip pallets, especially when the chipboard or cardboard has been weakened by exposure to moisture. To overcome vulnerability to moisture and for various other reasons, it has been proposed to fabricate slip pallets from one piece of a relatively thin plastic material. For example, U.S. Pat. No. 3,776,145 discloses a slip pallet made from a pliable sheet of single thickness thermoplastic resin having a thickness of about 20 to about 125 mils. Flaps for gripping the slip pallet located about the edges of the pallet are defined by score lines in the thermoplastic resin. The flaps may then be bent about the score lines for gripping by the lift truck. These pallets do not suffer from moisture weakening as do those made from chipboard. The score lines, however, significantly weaken the strength of the pallet and may cause the flaps to tear off, especially when moderate to heavy loads are supported on the pallet. Furthermore, the normal position of the flaps is in the plane of the container support surface. After a flap has been bent upward for gripping by the mechanism, it will "spring back" to its normal position. Thus, the flaps will normally extend outward in the plane of the pallet causing damage to neighboring arrays of containers and requiring manual bending of the flaps prior to gripping by the gripping mechanism. For these reasons, the prior art slip pallets have proven to be unsatisfactory in certain respects.

DESCRIPTION OF THE PREFERRED EMBODIMENTS

Now, referring to the accompanying drawing of various illustrative and presently preferred embodiments of the invention, FIG. 1 is a perspective view of a slip pallet of the invention;

Figure 1:
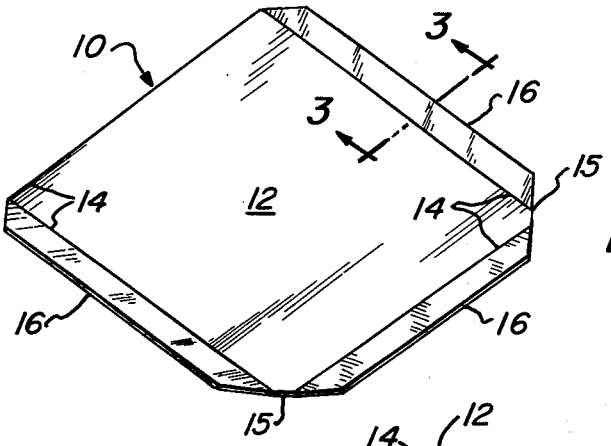
Figure 2:
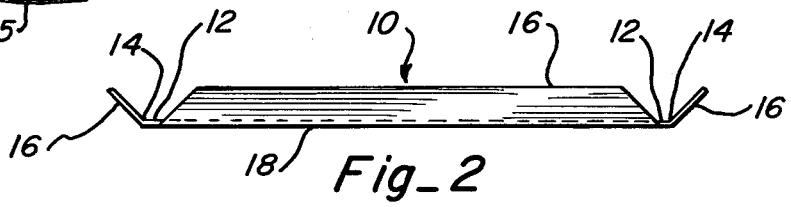
FIG. 2 is a side elevational view of the slip pallet of FIG. 1.
Figure 3:
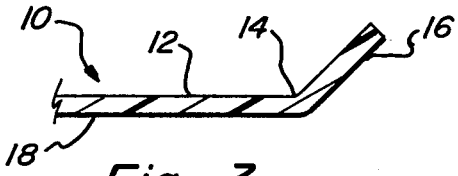
FIG. 3 is a partial cross-sectional view of the slip pallet taken along the lines 3—3 of FIG. 1.

Referring now to FIGS. 1–3, pallet member 10 is made of relatively thin thermoplastic sheet material, such as polypropylene or a propylene-ethylene copolymer, and comprises an upwardly facing container support surface 12 defined by opposite pairs of generally parallel edges 14. The container support surface is designed to have a peripheral configuration generally corresponding to the lower surface of an array of containers to be loaded onto the pallet member. A downwardly facing support surface (shown at 18 in FIG. 2) extends generally parallel to the upwardly facing container support surface and has a peripheral configuration generally corresponding to the upper surface of another array of containers to be located beneath the pallet member in a supporting relationship therewith. The pallet member may comprise diagonally cut corners 15 preventing edge lines 14 from intersecting. Integral flap portions 16 extending upwardly and outwardly from the plane defined by the upwardly facing container support surface 12 are provided along at least two of edges 14 of the pallet member in spaced protective relationship to the adjacent side surfaces of an array of containers located on the pallet member. It has been determined that flaps should preferably be provided along three edges of the pallet member to allow access from three potentially accessable sides by the lift truck, the remaining sde normally being adjacent a wall or a separate array of containers. The flap portion 16 is permanently formed in its upwardly outwardly extending position along edges 14 as can be more clearly seen in FIGS. 2 and 3. The flap portion can be heat formed in its permanent position or can be formed by other means readily apparent to those skilled in the art. The flap portion is integral with the pallet member along edges 14 and since no score lines are made in the pallet member for purposes of bending the flaps, the tensile strength of the pallet remins substantially the same along edge lines 14 as for the remainder of the pallet member. The permanent outwardly upwardly extending position of the flap portions is designed to facilitate gripping by the gripping mechanism of a suitable lift truck, to provide protection for the lower side of an array of containers to be located thereon and to minimize damage to neighboring arrays of containers. For most purposes, an angle of 45° from a plane defined by the container support surface is deemed to be adequate. Flap portions 16 are resiliently deflectible with respect to this permanent position.

Referring now to FIGS. 4–9, divider member 50, made of relatively thin thermoplastic sheet material such as, for example, polypropylene or a propylene-ethylene copolymer and having a thickness of about 0.050 to about 0.150 in., preferably about 0.090 in., comprises a downwardly facing support surface 52 defined by opposite pairs of generally parallel edges 54. The downwardly facing support surface has a peripheral configuration generally corresponding to the upper surface of an array of containers on which the divider member is placed. The divider member further comprises an upwardly facing support surface 56 extending generally parallel to the downwardly facing support surface and generally corresponding to the periphera configuration of the downwardly facing support surface of pallet member 10.

Figure 4:
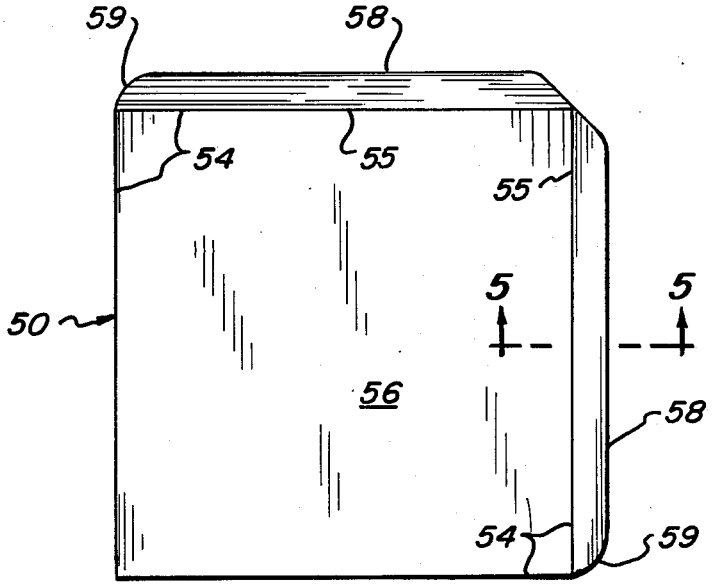
FIG. 4 is a top view of a divider sheet of the invention.
Figure 5:
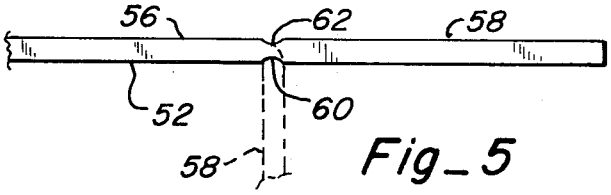
FIG. 5 is a side view of a portion of the divider sheet of FIG. 4 taken along the lines 5—5 in FIG. 4.

As seen in FIGS. 4 and 5, an illustrative divider member further comprises at least two flap portions 58 integral with the divider member and formed by scored grooves 60, 62 along edges 55 of the divider member. Scored groove 60 extends along the bottom of the divider member and is preferably about 0.112 in. wide and about 0.040 in. deep for a divider sheet having a thickness of about 0.090 in. The divider may also optionally comprise scored groove 62 extending along the top of the divider, having smaller dimensions than scored groove 60. Scored groove 62 may be, for example, about 0.100 inch wide and about 0.020 inch deep. The scored grooves facilitate the bending of the flap portions to a generally outwardly and downwardly extending position as shown by the broken lines in FIG. 5.

Figure 6:
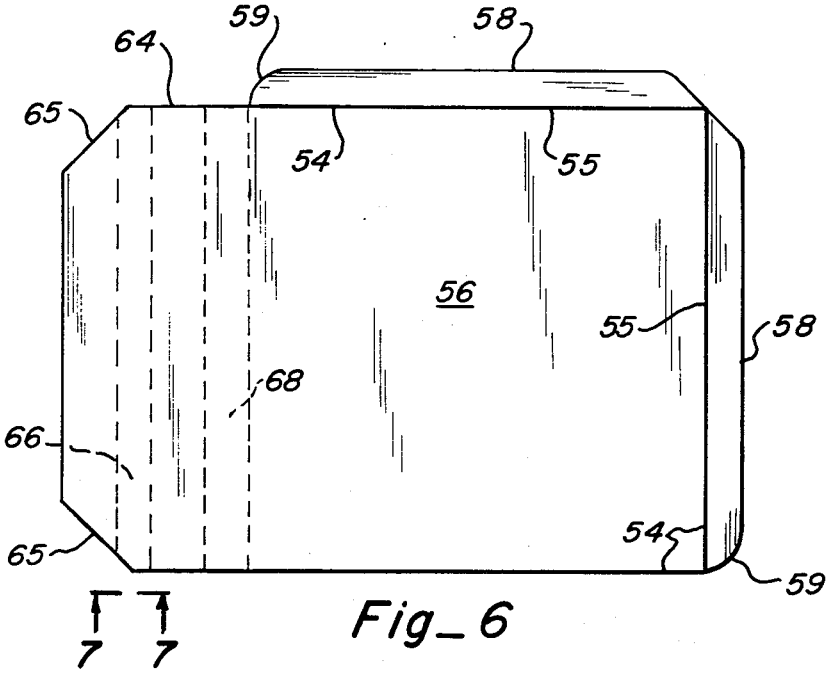
FIG. 6 is a top view of another embodiment of the divider sheet of the invention.
Figure 7:
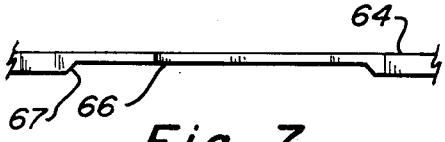
FIG. 7 is a side view of a portion of the divider sheet of FIG. 6 taken along the lines 7—7, in FIG. 6.

Referring to FIGS. 6–7, the divider member 50 can be further provided with an extended flap portion 64 having a plurality of relatively wide grooves 66, 68, for bending flap portion 64 in a generally downward direction, relative to upwardly facing support surface 56, at different points depending on the width of the array of containers to be located therebelow. As shown in FIG. 7, the grooves 66, 68 are defined by edge surfaces 67 which are preferably formed at an angle of approximately 45° from the top surface of extended flap portion 64, and have a relatively wide width of, for example, 2 inches and a depth of approximately 0.070 in. for a divider having a thickness of about 0.090 in. Flap portions 58 and extended flap portions 64 may also be provided with rounded corners 59 and angled corners 65, respectively, to minimize damage to neighboring arrays.

Figure 8:
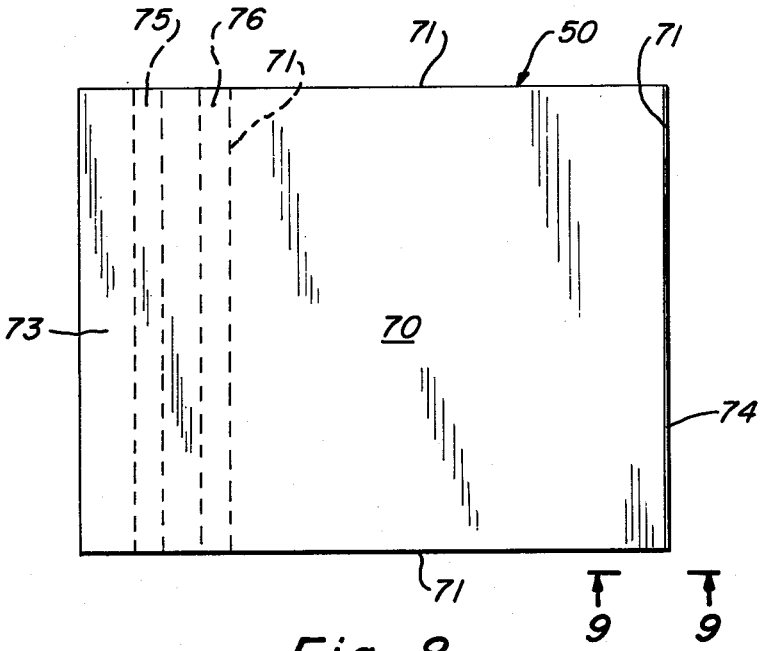
FIG. 8 is a top view of a presently preferred divider sheet of the invention.
Figure 9:
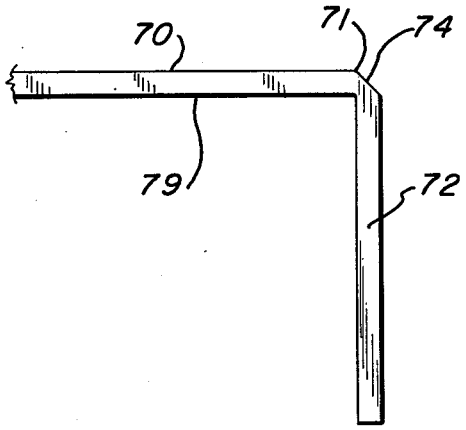
FIG. 9 is a side view of a portion of the divider member of FIG. 8 taken along the lines 9—9 in FIG. 8.

Referring to FIGS. 8–9, presently preferred embodiment of divider member 50, similarly made of relatively thin thermoplastic sheet material, comprises upwardly facing support surface 70 generally defined by edge surfaces 71, downwardly facing support surface 79, at least one downwardly extending flap portion 72 and extended flap portion 73. The flap portion 72 is integrally connected with the divider member 50 by connecting portion 74 and is permanently formed in its downwardly extending position along an edge surface 71 at an angle of approximately 90° from a plane defined by upwardly facing support surface 70. Flap portion 72 can be heat formed in its permanent position or can be formed by other means readily apparent to those skilled in the art. Extended flap portion 73 is integrally formed with divider member 50 and has at least one relatively wide groove on the surface adjacent downwardly facing support surface 79, two such grooves being generally shown at 75, 76 in FIG. 8. Grooves 75, 76 are preferably similar to grooves 66, 68 in extended flap portion 64 of FIGS. 6–7. Since flap portion 72 is permanently formed in a downwardly extending direction at an angle of approximately 90° from a plane defined by upper support surface 70, the flap portion 72 will not cause damage to neighboring arrays of containers and therefore the corners of the flap portion do not need to be rounded as are the corners 59 of flap porions 58 of FIGS. 4, 6. Similarly, angled corners 65 of extended flap portion 64 in FIG. 6, may be eliminated if desired to form square corners 77 of extended flap portion 73, FIG. 8.

Figure 10:
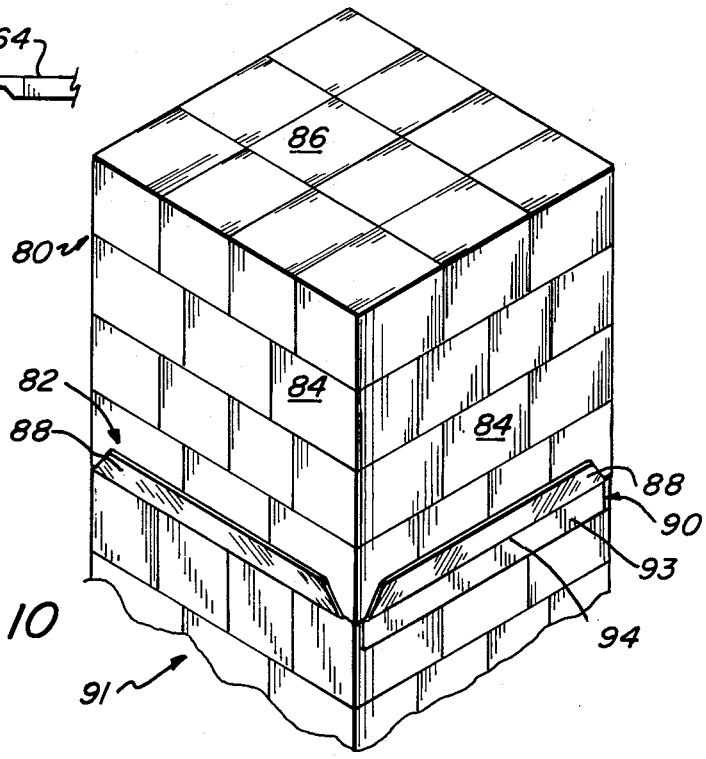
FIG. 10 is a perspective view of a slip pallet and divider sheet of the invention as used in conjunction with arrays of containers.

Referring to FIG. 10, when a pallet member with its upwardly outwardly extending flap portions in placed upon a divider member, as for example the divider member of FIGS. 8–9, with downwardly extending flap portions, the corresponding flap portions of the pallet member and the divider member define an outwardly diverging slot 94 for insertion of the support device of the lift truck as is hereinafter described.

In use, an array of containers 80 is supported on a pallet member 82 for hauling and storage. The array of containers has a predetermined configuration with aligned vertically extending side surfaces 84 and vertically spaced horizontally extending upper and lower surfaces 86. The pallet is designed to have a peripheral configuration generally corresponding to the lower surface of the array 80. After the containers have been stacked on the pallet, the array is moved by means of a lift truck (not shown) having a platen, or spatula-like support device, and suitable means for gripping the flaps 88 of the pallet. The gripping means grips one of the flaps on the pallet and holds it under tension while the platen of the lift truck is inserted underneath the pallet. The lift truck may then transport the pallet to a suitable location where it is pushed off of the platen.

For stacking of a plurality of arrays of containers, a divider 90 is placed on top of each array, as, for example, of array 91. The divider is designed to have a peripheral configuration generally corresponding to the upper surface of the aray 91. Then, as the arrays are stacked, each successive pallet memmber is placed is supportive relationship with the divider sheet on the array immediately therebelow. In this manner, the divider member provides support for the pallet across its full cross sectional area and provides protection for the top of the array of containers located immediately therebelow. The upwardly outwardly extending flap portions 88 of the pallet and the downwardly extending flap portion 93 of the divider also provide a slot area 94 allowing access for insertion of the platen or support device of the lift truck between the pallet and the divider. When the divider member further comprises the extended flap portions 64, 73 of FIGS. 6, 8, the downwardly bendable extended flap portion becomes lodged between a neighboring stack of arrays of containers and the array 91, thereby preventing the divider member from sliding across the top surface of array 91 as the platen is withdrawn from between the pallet member and the divider member.

The above descibed system for transporting and stacking arrays of containers can be seen to have general applicability to various types of arrays of containers that are capable of being stacked on pallets.

The slip pallets and divider sheets as herein described are made of one piece of relatively thin plastic sheet material and the peripheral size and configuration of the pallet member and the divider member will vary depending on the nature of the array to be supported. For purposes of supporting and moving cartons of filled beer cans in which each array contains 120 cartons and weighs about 2,700 lbs., it has been determined that slip pallets made from Polypropylene 7328, produced by the Shell Chemical Company, Houston, Tex., at a thickness of about 0.030 to about 0.110 inch are useful, the presently most preferred pallet being about 0.070 inch in thickness. Divider members made of the same material can be about 0.050 to 0.150 inch, the presently most preferred divider being about 0.090 inch. The lower limit of thickness of the pallet and the divider is dependent on strength requirements of the members while the upper limit is based on economic considerations.

While inventive concepts have been disclosed herein in reference to a presently preferred and illustrative embodiment of the invention, it is comtemplated that these concepts may be variously otherwise employed and embodied in alternate structure. It is intended that the appended claims be construed to cover alternate embodiments of the inventive concepts except insofar as precluded by the prior art.

What is claimed is:

1. Apparatus for transporting and stacking, by use of a support device of a lift truck, an array of containers in a predetermined configuration including aligned vertically extending side surfaces and vertically spaced horizontally extending upper and lower surfaces and comprising:

a pallet member made of one piece of relatively thin plastic sheet material, an upwardly facing container support surface on said pallet member defined by opposite pairs of generally parallel edges thereon having a peripheral configuration generally corresponding to the lower surface of an array of containers to be located thereabove in supportive engagement therewith, a downwardly facing support surface on said pallet member extending generally parallel to said upwardly facing container support surface and having a peripheral configuration generally corresponding to the peripheral configuration of the upper surface of another array of containers to be located therebeneath, an upwardly outwardly extending flap portion integral with said pallet member provided along at least one of said edges and being permanently formed in a generally upwardly outwardly extending postition relative to said upwardly facing container support surface to extend upwardly outwardly thereabove in space protective relationship to the adjacent side surface of the array of containers supported thereon while being resiliently deflectable relative to said upwardly outwardly extending position;

a divider member made of one piece of relatively thin plastic sheet material;

a downwardly facing support surface on said divider member defined by opposite generally parallel edges thereon having a peripheral configuration generally corresponding to the upper surface of an array of containers located therebeneath in supportive engagement therewith;

an upwardly facing support surface on said divider member extending generally parallel to said downwardly facing support surface and generally corresponding to the peripheral configuration of the lower surface of the array of containers thereabove for supportive engagement with the downwardly facing support surface on said pallet member;

a downwardly extending flap portion integral with said divider member provided along at least one of said edges corresponding in location to at least one of said edges of said pallet member having said upwardly outwardly extending flap portion thereon and being in a generally downwardly extending position relative to said downwardly facing support surface to extend downwardly therebelow in spaced protective relationship to the adjacent side surface of the other array of containers located therebelow; and said upwardly outwardly extending flap portion on said pallet member and said downwardly extending flap portion of said divider member defining an outwardly diverging slot providing access for insertion of the support device of the lift truck in the space between said downwardly facing support surface on said pallet member and the upwardly facing surface on said divider member.

2. The apparatus of claim 1 wherein flap portions are provided along three edges of the pallet member.

3. The apparatus of claim 1 wherein corners of the pallet member extend diagonally across adjacent edges of the container support surface preventing said adjacent edges from intersecting.

4. The apparatus of claim 1 wherein the flap portion of the pallet member is heat formed in the generally upwardly outwardly extending position.

5. The apparatus of claim 1 wherein the flap portion of the divider member is integrally associated with said divider member by means of a resilient hinge defined by a first scored groove extending along the edge of the divider member on the downwardly facing support surface.

6. The apparatus of claim 5 wherein the resilient hinge is further defined by a second scored groove extending along the edge of the divider member on the upwardly facing support surface, and wherein the second scored groove is relatively smaller than the first scored groove.

7. The apparatus of claim 1 wherein the flap portion of the divider member is permanently formed in the downwardly extending position.

8. The apparatus of claim 7 wherein the flap portion of the divider member is head formed in the downwardly extending position.

9. The apparatus of claim 1 wherein flap portions are provided along three edges of the divider member.

10. The apparatus of claim 1 which further comprises an extended flap portion along one of the edges of the divider member.

11. The apparatus of claim 10 which further comprises at least one relatively wide groove on the extended flap portion for bending the extended flap portion downwardly along various lines in the relatively wide scored groove depending on the width of the upper surface of the array of containers located therebeneath.

12. The apparatus of claim 1 which further comprises rounder corners on the divider member.

13. In an apparatus for transporting and stacking, by use of a support device of a lift truck, an array of containers in a predetermined configuration including aligned vertically extending side surfaces and vertically spaced horizontally extending upper and lower surfaces, a divider member made of one piece of relatively thin plastic sheet material comprising:

a downwardly facing support surface on said divider member defined by opposite generally parallel edges thereon having a peripheral configuration generally corresponding to the upper surface of an array of containers located therebeneath in supportive engagement therewith, an upwardly facing support surface on said divider member extending generally parallel to said downwardly facing support surface and generally corresponding to the peripheral configuration of the lower surface of the array of containers thereabove for supportive engagement with the divider member, and at least one downwardly extending flap portion integral with said divider member provided along at least one of said edges in a generally downwardly extending position relative to said downwardly facing support surface to extend downwardly therebelow in spaced protective relationship to the adjacent side surface of the array of containers located therebelow, the flap portion being integrally associated with said divider member by means of a resilient hinge defined by a first scored groove extending along the edge of the divider member on the downwardly facing support surface and a second scored groove extending along the edge of the divider member on the upwardly facing support surface, and wherein the second groove is relatively samller than the first scored groove.

14. The divider member of claim 13 wherein the flap portion is permanently formed in the downwardly extending position.

15. The divider member of claim 14 wherein the flap portion is heat formed in the downwardly extending position.

16. The divider member of claim 13 wherein flap portions are provided along three of said edges.

17. In an apparatus for transporting and stacking, by use of a support device of a lift truck an array of containers in a predetermined configuration including aligned vertically extending side surfaces and vertically spaced horizontally extending upper and lower surfaces, a divider member made of one piece of relatively thin plastic sheet material comprising:

a downwardly facing support surface on said divider member defined by opposite generally parallel edges thereon having a peripheral configuration generally corresponding to the upper surface of an array of containers located therebeneath in supportive engagement therewith, an upwardly facing support surface on said divider member extending generally parallel to said downwardly facing support surface and generally corresponding to the peripheral configuration of the lower surface of the array of containers thereabove for supportive engagement with the divider member, at least one downwardly extending flap portion integral with said divider member provided along at least one of said edges in a generally downwardly extending position relative to said downwardly facing support surface to extend downwardly therebelow in spaced protective relationship to the adjacent side surface of the array of containers located therebelow, and an extended flap portion along one of said edges having at least one relatively wide scored groove on the extended flap portion for bending the extended flap portion downwardly along various lines in the relatively wide scored groove depending on the width of the upper surface of the array of containers located therebeneath.

* * * * *

UNITED STATES PATENT AND TRADEMARK OFFICE

CERTIFICATE OF CORRECTION

PATENT NO. : 4,042,127

DATED : August 16, 1977

INVENTOR(S) : Charles Edward Brossia

It is certified that error appears in the above-identified patent and that said Letters Patent are hereby corrected as shown below:

Column 2, line 61, "Sde" should read --sides--; Column 3, line 28, "periphera" should read --peripheral--; Column 4, line 21, "porions" should read --portions--; Column 4, line 27, "in" should read --is--; Column 4, line 52, "of" should read --on--; Column 4, line 55 "is" (second occurrence) should read --in--; Column 5, line 6, "descibed" should read --described--; Column 6, line 29, "of" should read --on--; Column 6, line 59, "head" should read --heat--; Column 7, line 6, "rounder" should read --rounded--; Column 7, line 43, "Samller" should read --smaller--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*